United States Patent [19]

Townsend

[11] 3,995,950

[45] Dec. 7, 1976

[54] EXPOSURE SYSTEM FOR ELECTROSTATIC MACHINES

[75] Inventor: Robert H. Townsend, Richardson, Tex.

[73] Assignee: Xerox Corporation, Stamford, Conn.

[22] Filed: Feb. 13, 1975

[21] Appl. No.: 549,588

[52] U.S. Cl. ..... 355/3 R; 355/67

[51] Int. Cl.[2] ..... G03G 15/00

[58] Field of Search ..... 355/3 R, 67, 69, 70

[56] References Cited

UNITED STATES PATENTS 3,696,717 10/1972 Honma et al. ..... 355/67 X

FOREIGN PATENTS OR APPLICATIONS 2,044,584 3/1972 Germany ..... 355/67

*Primary Examiner*—R. L. Moses

[57] ABSTRACT

An electrostatic reproduction machine with photosensitive member on which latent electrostatic images of an original being reproduced are made following charging of a photosensitive member, the images being developed or transferred to a sheet of copy paper which is thereafter fused to form a permanent copy. A transparent platen supports the original with one or more relatively low power flash lamps being provided to illuminate the original resting on the platen. The light image produced is transmitted by an optical system to the photosensitive member to discharge the same selectively in accordance with the original. A movable optical system is provided to permit the light image to be projected onto the photosensitive member more than once in accommodation of the relatively low power of the flash lamps.

9 Claims, 4 Drawing Figures

EXPOSURE SYSTEM FOR ELECTROSTATIC MACHINES

This invention relates to a flash exposure system for an electrostatic type reproduction machine, and more particularly to an improved flash exposure system using relatively low power flash lamps.

Modern high speed electrostatic type copiers or reproduction machines may use flash lamps to illuminate, i.e. expose, the original being copied. Use of this type of lamp is highly advantageous as providing the necessary exposure speed for very high speed copying. In these arrangements, the entire original is illuminated by the flash lamps providing what is known to the art as full frame exposure.

Since the originals to be copied may be relatively large, and the entire area must be illuminated fully, flash lamps must generate intense light energy over the span of a few microseconds. To support such illumination intensity in turn requires a very large amount of electrical energy with attendant large, expensive, and relatively dangerous capacitance type power supply.

It is therefore a principal object of the present invention to provide a new and improved exposure system for electrostatic type reproduction machines.

It is an object of the present invention to provide an improved flash illumination system for copiers permitting the use of relatively low power flash lamps to illuminate the originals being copied.

It is an object of the present invention to provide an illumination system requiring relatively low power flash illumination lamps for electrostatic copiers.

It is an object of the present invention to provide an exposure system wherein the optical path is displaced during imaging in timed relation to movement of the photoreceptor in an electrostatic reproduction machine to thereby permit multiple illuminations of the original to be made without blurring using under powered flash lamps.

This invention relates to a reproduction machine for producing copies of an original, comprising, in combination, a movable photosensitive member, means to charge the photosensitive member in preparation for imaging; an exposure station whereat the charged photosensitive member is exposed to a light image of the original; a platen for supporting the original; image means forming an optical path for transmitting a light image of the original on the platen to the exposure station and the photosensitive member to form a latent electrostatic image of the original on the member; relatively low power flash illumination means adapted when triggered to illuminate the platen and the original thereon; optical path displacing means to displace the optical path formed by the image projecting means conjointly with the photosensitive member and in substantial parallelism with the photosensitive member at the exposure station; and control means to trigger the flash illumination means at least twice for each copy of the original to be made and thereby project in cooperation with the optical path displacing means at least two full frame overlapping exposures of the original onto the photosensitive member whereby to form the latent electrostatic image as aforesaid.

Other objects and advantages will be apparent from the ensuing descriptions and drawings in which.

Figure 1:
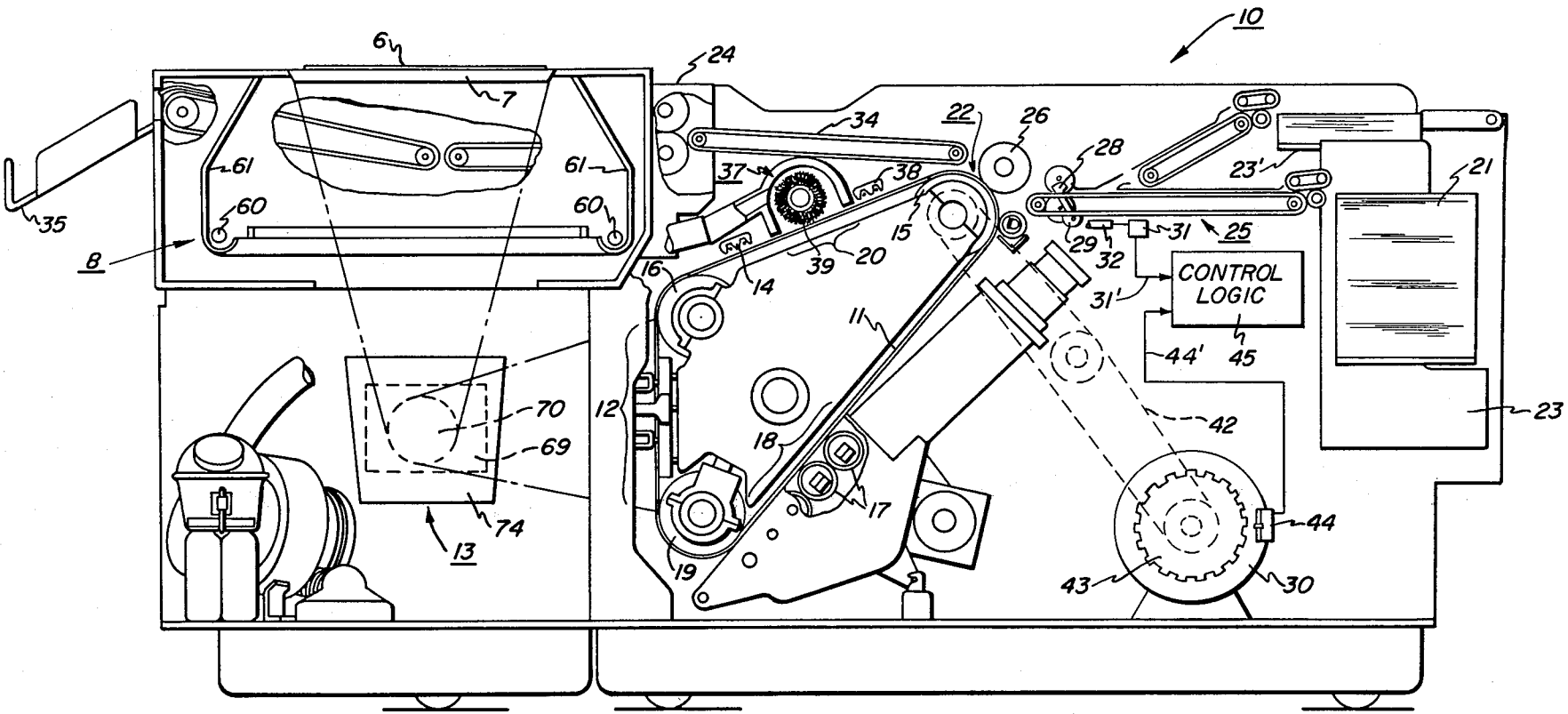
FIG. 1 is a side view in section of an exemplary reproduction machine of the type adapted to incorporate the improved exposure system of the present invention.

For a general understanding of an electrostatic type reproduction machine or copier in which the invention may be incorporated, reference is had to the drawing FIG. 1 wherein various components of an exemplary machine, designated generally by the numeral 10, are schematically illustrated. As in most electrostatic type machines, a light image of an original 6 to be copied or reproduced is projected onto the sensitized surface of a xerographic plate, herein the form of an endless belt 11, to form an electrostatic latent image thereon. The latent image is then developed as by means of magnetic brushes 17 to form a xerographic powder image, corresponding to the latent image on belt 11. The powder image is then electrostatically transferred to a support surface such as a copy sheet 21 and then permanently fixed by fusing apparatus 24.

The electrostatically attractable developing material commonly used in magnetic brush developing apparatus such as illustrated comprises a pigmented resinous powder commonly referred to as "toner" and a "carrier" of larger granular beads. The latter may be formed with steel cores coated with a material removed in the triboelectric series from the toner so that a triboelectric change is generated between the toner and the carrier. The magnetizable carrier also provides mechanical control for the formation of brush bristles by magnetic brushes 17 by virtue of magnetic fields generated by the brush magnets. This permits the toner to be readily handled and brought into contact with the exposed xerographic surface. The toner is then attracted to the electrostatic latent image on belt 11 from the carrier to produce a visible powder image.

In machine 10, original 6 to be copied is placed upon a transparent support platen 7 fixedly arranged in an illumination assembly, generally indicated by the reference numeral 8. The illumination system 8 includes two or more flash lamps 60 and attendant reflectors 61, lamps 60 serving when energized to flash light rays upon the original 6 to produce image rays corresponding thereto. The image rays are projected by means of an optical system 13, which includes lens 70 and mirrors 69, 74. The opitcal system focuses the image rays on the photosensitive surface of the moving belt 11 at exposure station 12. Belt 11 moves in the direction indicated by the arrow and carries a uniform charge placed thereon by a corona device 14.

Exposure of the photosensitive surface of belt 11 to the light image discharges the photoconductive layer in the areas struck by light so that there remains on belt 11 a latent electrostatic image corresponding to the light image of original 6 as projected by the optical system 13. The electrostatic image so formed passes into operative contact with magnetic brushes 17 of developing station 18.

Belt 11 is stretched about three rollers 15, 16, 19 to form three relatively flat runs opposite exposure station 12, developing station 18, and cleaning station 20. Suitable means (not shown) such as vacuum panels may be utilized for maintaining the belt flat at the aforesaid belt runs.

The developed electrostatic image on belt 11 is transferred at transfer station 22, located at a point of tangency on the belt as it moves around roller 15, to the copy sheet 21. Sheet 21 is brought forward from supply tray 23 by transport means 25 at a speed in synchronism with the moving belt. A transfer roller 26 is provided, roller 26 being electrically biased with sufficient voltage to electrostatically transfer the developed image from belt 11 onto copy sheet 21 as sheet 21 passes between the nip formed by belt 11 and roller 26.

A suitable copy sheet separating apparatus is provided for feeding one sheet 21 at a time from supply tray 23 to transport means 25. An auxiliary sheet supply tray 23' with transport is also provided.

Sheet transport means 25 includes sheet register fingers 28 adjacent the upstream side of transfer station 22, fingers 28 serving to place the individual copy sheets 21 in registration with the image on belt 11. Fingers 28 are supported upon rotatable shaft 29 driven from main machine motor 30. For correlating the operational timing of the several components of the reproduction machine 10, a control signal generator 31 is provided, pickup 32 of generator 31 being driven in unison with sheet register fingers 28. As a result, generator 31 puts out a control signal pulse once each revolution of fingers 28, the signal pulse from generator 31 representing a predetermined reference for timing machine operation.

After transfer, sheet 21 is stripped from belt 11, and conveyed by a conveying system 34 to fusing apparatus 24 wherein the toner image is permanently affixed to sheet 21. After fusing, the finished copy is discharged into the tray 35.

Toner particles remaining as residue from the developed images are removed by cleaning apparatus 37 positioned opposite the run of belt 11 between the rollers 15, 16. Cleaning apparatus 37 includes a corotron 38 for neutralizing charges remaining on the particles and a rotating brush 39 which operates in conjunction with a vacuum system to remove residual toner particles from the brush.

Belt 11 is driven in the direction shown by the solid line arrow by a constant speed drive motor 30 directly coupled to belt driving roller 15 by a suitable drive chain or timing belt 42. A timing gear 43 is carried on the output shaft of motor 30, gear 43 having a predetermined number of teeth cooperable with magnetic pickup element 44 mounted on the machine frame adjacent thereto. During rotation of gear 43, pickup 44 generates a series of closely spaced signal pulses which are inputted to control logic 45 via line 44'. Pulse like signals from signal generator 31, are inputted to control logic 45 via line 31'. The signal pulses in lines 44', 31' cooperate to operate the various components of reproduction machine 10 in an integrated timed manner via control logic 45. For this purpose, the control logic 45 for machine 10 includes a suitable counting mechanism for counting and identifying individual pulses.

The pulse train from pickup 44 is fed to control logic 45 together with the pulse like signals from pickup 32 of signal generator 31. In operation, the pulses from pickup 32 are used to mark or set the count each time fingers 28 reach a preset point in their rotation. Individual pulses from the resulting blocks of pulses obtained are then used to operate the various components of the machine 10 such as flash lamps 60 in an integrated timed manner.

As noted, flash lamps 60 of illumination assembly 8 serve to illuminate the platen 7 and any original 6 thereon. The substantially instantaneous nature of this type of illumination in effect stops belt 11 to provide an image free of blur. However, the amount and intensity of light required to uniformly and completely illuminate the entire platen 7 from corner to corner in the space of a few microseconds is extremely large. As a result, flash lamps 60 must have very large and relatively expensive power supplies. Normally, power supplies for this use are of the capacitance type wherein the electric power required to fire lamps 60 is stored on one or more capacitors which are discharged at the instant of flash.

To reduce the light required and thus the size and capacity of the flash lamp power supply, a moving image is generated on belt 11 by the optical system 13 permitting more than one full frame exposure of the original to be made. This in turn permits the use of relatively low or under powered flash lamps. Additionally, where the power supply includes multiple storage capacitors, sequential firing using individual or groups of capacitors may be accomplished. This would allow discharged capacitors to recharge during the firing of lamps 60 from another capacitor or capacitor group.

Figure 2:
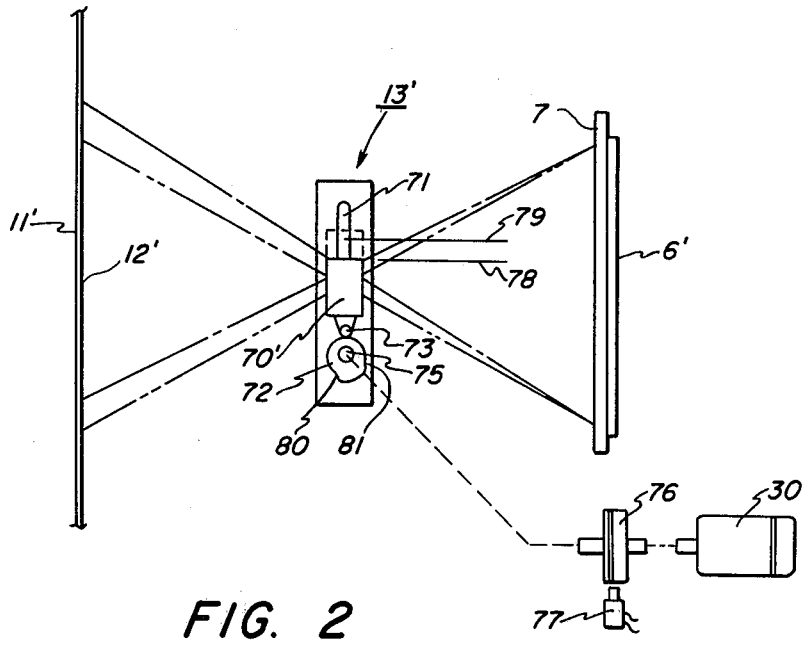
FIG. 2 is a schematic view of a direct optical exposure system illustrating the basic principles of the present invention.

Referring to the schematic showing in FIG. 2, the optical system 13' there shown comprises a single lens 70' adapted to transmit light image rays of an original 6' onto a moving xerographic plate 11' at exposure station 12'. Lens 70' is suitably supported in tracks 71 for slidable back and forth movement in a direction substantially paralleling the path of movement of plate 11' through exposure station 12'. A rotatable lens driving cam 72 is provided, cam follower 73 thereof being coupled to lens 70' to move lens 70' back and forth in tracks 71 in correspondence with the configuration of driving cam 72. Suitable biasing means (not shown) holds follower 73 in operative contact with the surface of cam 72. Cam 72 is carried on a shaft 75 which is drivingly connected through solenoid operated clutch 76 with the apparatus power source, such as motor 30.

Clutch 76 is of the type adapted upon energization of solenoid 77 thereof to rotate cam 72 through one revolution. During rotation, cam 72 moves lens 70' first forward from start position 78 (shown in solid line) to terminal position 79 (shown by dotted lines) and then back to start position 78. The forward slope 80 of the surface of cam 72 is such that during initial rotation of cam 72 (through an approximately 90° arc), lens 70' is moved at exactly one-half the speed of plate 11' presuming a 1:1 copy to platen size ratio. This prevents blurring or distortion of the images. Return slope 81 of cam 72 is configured to return lens 70' to the start position 78 at a speed sufficient to allow fresh surface of plate 11' to reach exposure station 12'. Normally, provision is made here for inclusion of any spacing between adjoining images.

Other proportional speed relationships or ratios between xerographic plate 11' and lens 70' may be contemplated where different size images are produced, as for example, where a reduced size image is projected onto xerographic plate 11'. In this circumstance, the configuration of lens drive cam 72 would be modified to provide the required lens speed. As will be understood, a change in configuration of cam 72 may be conveniently effected by substituting a cam having the desired configuration for the cam 72 already in place.

As will appear, flash lamps 60 are triggered two or more times to provide multiple overlapping exposures of the original 6. Conveniently, a first exposure may be made while lens 70' is in the start position 78, i.e., before movement of lens 70' begins. A second exposure may be made when the lens 70' reaches the terminal position 78. Alternately, one or both exposures may be made while lens 70' is moving, or where more than two exposures are made, the additional exposures may be made during lens movement.

Figure 3:
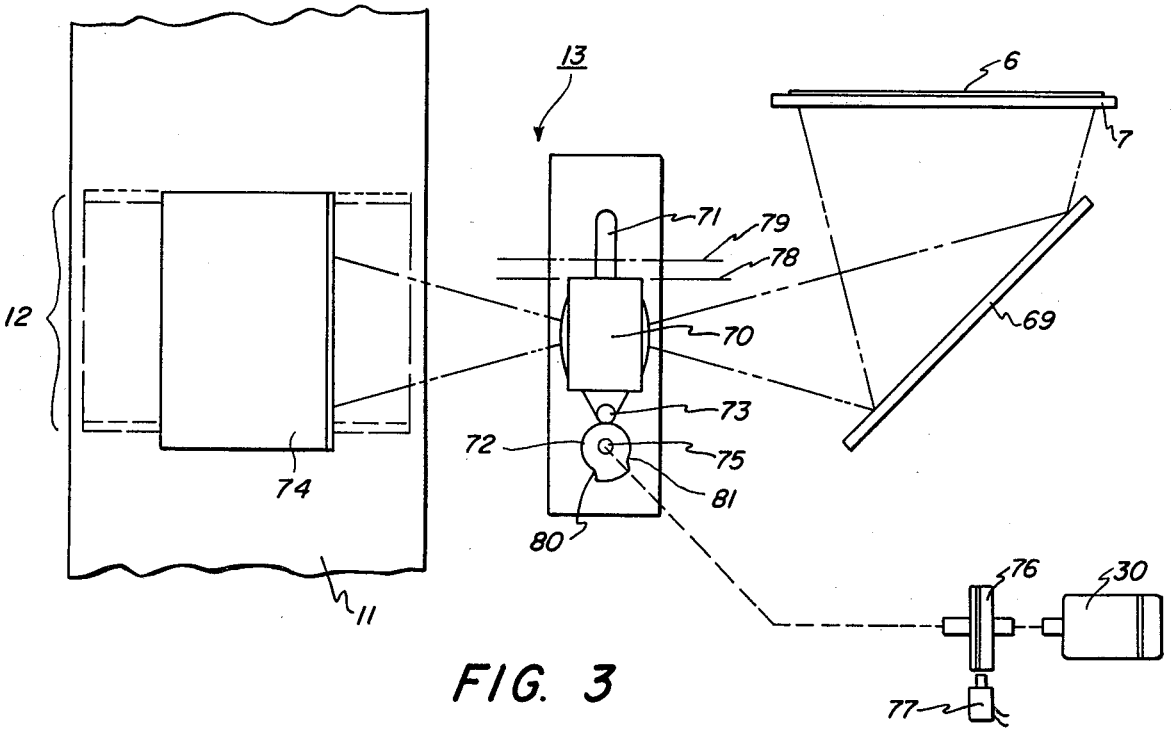
FIG. 3 is an enlarged top view showing the present invention incorporated into the reproduction machine shown in FIG. 1.

Referring now to FIGS. 1 and 3 of the drawings, lens 70 for reproduction machine 10 may be arranged for displacement along a path substantially paralleling the movement of belt 11 through exposure station 12 in the manner described heretofore in connection with FIG. 2. The optical system 13 for reproduction machine 10 includes a pair of mirrors 69, 74 for directing the light image rays from platen 7 to belt 11. Mirror 69 which is disposed below platen 7, serves to direct the image rays from platen 7 to the optical axis of lens 70 while mirror 74 serves to direct the image rays from lens 70 to the surface of belt 11 at exposure station 12.

Figure 4:
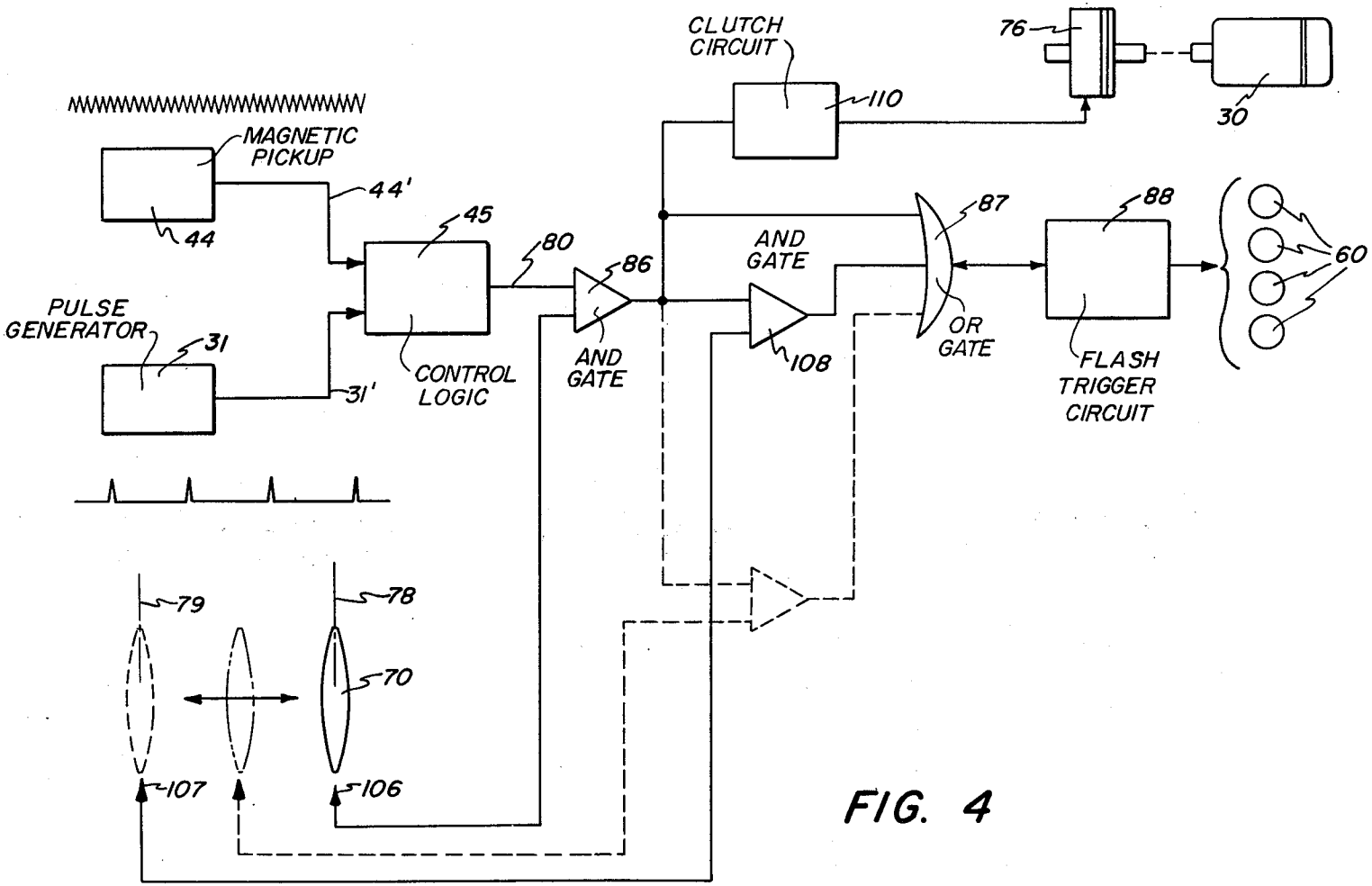
FIG. 4 is a control schematic for the machine illustrated in FIG. 1.

Referring now to the control arrangement schematically illustrated in FIG. 4, the pulse like output from pickup 44 is inputted to control logic 45 together with the discrete pulses from signal generator 31. Logic 45 controls actuation of the various operating elements of reproduction machine 10 in accordance with the program input of the operator, (i.e. number of copies, to be made) and in response to feedback signals from the components themselves in an integrated, timed manner. As described, the stream of pulses from pickup 44 are segregated into blocks by the pulse signals from signal generator 31 for use by logic 45 to operate the machine components including flash lamps 60.

The flash exposure signal from control logic 45 appears in line 80 and is passed through AND function circuit 86 and OR function circuit 87 to the input gate of a suitable flash triggering circuit 88. The signal output from circuit 88 controls discharge of the flash lamp power supply (not shown) and illumination of lamps 60.

The disposition of lens 70 is responded to by suitable sensors. In the FIG. 4 arrangement, sensors 106, 107 are provided to respond to the disposition of lens 70 in either the start or forward positions 78, 79 respectively. The signal output of sensor 106 enables circuit 86 while the output of sensor 107 enables AND function circuit 108. The signal output of circuit 86 is fed to the control gate of circuit 108. The output of circuit 108 actuates lamp energizing circuit 88 via OR function circuit 87.

The output of AND function citcuit 86 additionally controls energization of clutch actuating circuit 110 controlling operation of clutch 76.

In operation and referring to the schematic circuit illustrated, with lens 70 in the start position 78, a signal pulse from logic 45 in line 80 triggers circuit 86 to energize flash circuit 88 and trigger flash exposure lamps 60. It is understood that with lens 70 in start position 78, pick-up 106 responds to enable circuit 86. The signal from circuit 86 also triggers circuit 110 to engage clutch 76 and rotate cam 72 through one revolution. Rotation of cam 72 moves lens 70 in the same direction and at a predetermined speed ratio with respect to the speed of belt 11 as described heretofore. Following predetermined lens motion (in this case to the forward lens position 79) circuit 108 is enabled by a signal from sensor 107, and actuated in a timed manner by a second signal pulse from logic 45 in line 80 to again trigger lamps 60.

On reaching the forward position 79, lens 70 is returned to start position 78 by cam 72. On return of lens 70 to the start position 78, the machine optical system is ready for the next imaging cycle.

Should more than two exposures be desired, an additional pickup (or pickups) may be strategically located between the pickups 106, 107 to trigger flash lamps 60 as lens 70 moves through some intermediate position. For this purpose, additional activating circuits of the type heretofore discussed and shown generally in outline form in FIG. 4 are provided.

While the invention has been described with reference to the structure disclosed, it is not confined to the details set forth, but is intended to cover such modifications or changes as may come within the scope of the following claims.

What is claimed is:

1. In a reproduction machine for producing selectively one or more copies of an original, the combination of: a movable photosensitive member; drive means for moving said photosensitive member, means to charge the photosensitive member in preparation for imaging; an exposure station whereat said charged photosensitive member is adapted to be exposed to a light image of the original; a platen for supporting the original; image projecting means forming an optical path for transmitting a light image of the original on the platen to the exposure station and the photosensitive member to form a latent elctrostatic image of the original on said member;

relatively low power flash illumination means adapted when triggered to illuminate the platen and the original thereon to form each time said flash illumination means is triggered a light image of said original for transmittal to said exposure station by said image projecting means;

optical path displacing means to displace the optical path formed by said image projecting means conjointly with said photosensitive member and in substantial parallelism with said photosensitive member at said exposure station, and control means to trigger said flash illumination means at least twice for each copy of an original to be made and actuate said optical path displacing means to thereby project at least two full frame overlapping exposures of the original onto said photosensitive member, said overlapping exposures together forming said latent electrostatic image of the original.

2. The reproduction machine according to claim 1, in which said image projecting means includes a lens; and means supporting said lens for movement along a preset path substantially paralleling the path of said photosensitive member at said exposure station;

said optical path displacing means including driving means for moving said lens along said preset path at a predetermined speed.

3. The reproduction machine according to claim 2, in which said driving means is adapted to return said lens following the last exposure for said latent electrostatic image.

4. The reproduction machine according to claim 3, including inhibit means to prevent triggering of said flash illumination means until return of said lens is completed by said driving means.

5. The reproduction machine according to claim 2, in which said preset path of lens movement includes a lens start position, said control means being adapted to trigger said flash illumination means to provide a first exposure with said lens in said start position.

6. The reproduction machine according to claim 5, in which said control means is adapted to trigger said flash illumination means to provide an additional exposure following predetermined movement of said lens along said preset path.

7. The reproduction machine according to claim 6, in which said preset path of lens movement includes a terminal position, said control means being adapted to trigger said flash illumination means to provide said additional exposure on said lens reaching said terminal position.

8. The reproduction machine according to claim 2, in which said driving means is adapted to return said lens following the last exposure for said latent electrostatic image at a second predetermined speed.

9. The reproduction machine according to claim 2, in which said photosensitive member moves at twice said predetermined lens speed.

* * * * *